US008106316B2

(12) United States Patent
Manz

(10) Patent No.: US 8,106,316 B2
(45) Date of Patent: Jan. 31, 2012

(54) LOCKING AND OPERATING SYSTEM FOR GENERATOR CIRCUIT BREAKERS

(75) Inventor: Erwin Manz, Lauchringen (DE)

(73) Assignee: ABB Technology AG, Zurich (CH)

( * ) Notice: Subject to any disclaimer, the term of this patent is extended or adjusted under 35 U.S.C. 154(b) by 330 days.

(21) Appl. No.: 12/000,544

(22) Filed: Dec. 13, 2007

(65) Prior Publication Data

US 2008/0142343 A1 Jun. 19, 2008

(30) Foreign Application Priority Data

Dec. 15, 2006 (EP) ..... 06405521

(51) Int. Cl.
*H01H 9/28* (2006.01)

(52) U.S. Cl. ..... 200/43.11; 200/43.13

(58) Field of Classification Search .... 200/43.11–43.16, 200/43.01, 320, 321, 322, 327, 325
See application file for complete search history.

(56) References Cited

U.S. PATENT DOCUMENTS

| | | | | |
|---|---|---|---|---|
| 3,666,959 | A * | 5/1972 | Crews | 307/10.7 |
| 4,187,420 | A * | 2/1980 | Piber | 200/43.16 |
| 4,638,129 | A * | 1/1987 | Partus et al. | 200/43.22 |
| 6,218,633 | B1 * | 4/2001 | Okumura et al. | 200/43.17 |

FOREIGN PATENT DOCUMENTS

| | | | |
|---|---|---|---|
| DE | 41 10 982 | A2 | 10/1992 |
| DE | 197 12 346 | A1 | 10/1998 |
| FR | 1537910 | | 8/1968 |
| WO | WO 97/16660 | A1 | 5/1997 |
| WO | WO 00/58984 | A1 | 10/2000 |

OTHER PUBLICATIONS

European Search Report.

* cited by examiner

*Primary Examiner* — Elvin G Enad
*Assistant Examiner* — Lisa Klaus
(74) *Attorney, Agent, or Firm* — Buchanan Ingersoll & Rooney PC

(57) ABSTRACT

A control unit for an electrical switching device comprises: a control shaft which is rotatable about a control axis for operating a moveable contact of the electrical switching device, a first blocking mechanism for the control shaft, which can be activated to block a rotary movement of the control shaft in a first rotation direction, and an activation mechanism for the first blocking mechanism, which is designed to activate the first blocking mechanism.

35 Claims, 7 Drawing Sheets

LOCKING AND OPERATING SYSTEM FOR GENERATOR CIRCUIT BREAKERS

RELATED APPLICATION

This application claims priority under 35 U.S.C. §119 to European Patent Application No. 06405521.3 filed in the European Patent Office on 15 Dec. 2006, the entire contents of which are hereby incorporated by reference in their entireties.

TECHNICAL FIELD

The disclosure relates to a locking and operating system for generator circuit breakers. A control unit for an electrical switching device is disclosed.

BACKGROUND INFORMATION

When the control voltage or the drive power supply for the switching devices fails or is switched off in electrical switchgear assemblies, in the event of a malfunction or during planned maintenance work, then aids, such as hand cranks, are provided which allow the switching devices, which may possibly remain in an intermediate position, to be moved to a desired limit position. On the other hand, apparatuses are also known from switchgear technology for blocking the rotation of a shaft of an electrical drive for a moving contact of a switching device, which apparatuses prevent operation of switching devices at an unacceptable time, or by unauthorized personnel. These apparatuses are used for personal protection of the personnel working in the switchgear assembly, and also for operational reliability of the respective switchgear assembly.

However, it may also be necessary for example, to switch on grounding devices by hand so that the fitter can safely carry out repairs or maintenance work in the switchgear assembly. The hand cranks which are required for this purpose are connected in an interlocking manner to the drive shaft of the relevant switching device. In order to prevent unauthorized manual operation of these drives, the access to this drive shaft is prevent by means of safety covers. When manual actions are intended to be carried out, then an appropriate specialist person is employed by a control center to carry out these switching operations. Only this person has the necessary special tool in order to remove these safety covers. It is also possible to interrupt the electrical control circuit for the relevant drive motor by means of limit switches which are operated by the hand crank, in order to prevent the possibility of the drive motor being electrically initiated, for as long as it is being moved manually.

DE 197 12 346 discloses an electromechanical apparatus for blocking the rotation of a shaft of an electrical drive for a moving contact in a switching device. DE 41 10 982 discloses a locking apparatus for blocking or releasing a shaft end, onto which an operating lever for manual rotation operation can be pushed.

However, there are various problems which are not solved by the known apparatuses, for example relating to safe and reliable operation and the capability for quick and simple manual access, particularly in the event of failure of the electrical supply.

SUMMARY

An improved locking system for an electrical switching device is disclosed. The aim is achieved by a control unit and by a locking system.

A control unit for an electrical switching device is disclosed which comprises a control shaft which can be rotated about a control axis in order to operate a moveable contact of the electrical switching device, a first blocking mechanism for the control shaft, which is designed to be activated in order to block a rotary movement of the control shaft in a first rotation direction, and an activation mechanism for the first blocking mechanism, which has means for activation of the first blocking mechanism.

A locking system for locking an access for an electrical switching device is disclosed which comprises a setting shaft, which is rotatable about a setting axis, for setting a plurality of setting states by selection of the rotation angle of the setting shaft, with the plurality of setting states comprising a first setting state and a second setting state; and a locking disk which is rotatable together with the setting shaft, with at least one of the plurality of setting states being a locked setting state, and with at least one of the plurality of setting states being an unlocked setting state, and with the locking disk being designed in order to lock the access to the operating system when a locked setting state occurs, and in order to release the access to the operating system when an unlocked setting state occurs.

BRIEF DESCRIPTION OF THE DRAWINGS

Exemplary embodiments of the disclosure will be described in more detail in the following text, and are illustrated in the figures, in which.

DETAILED DESCRIPTION

Figure 1:
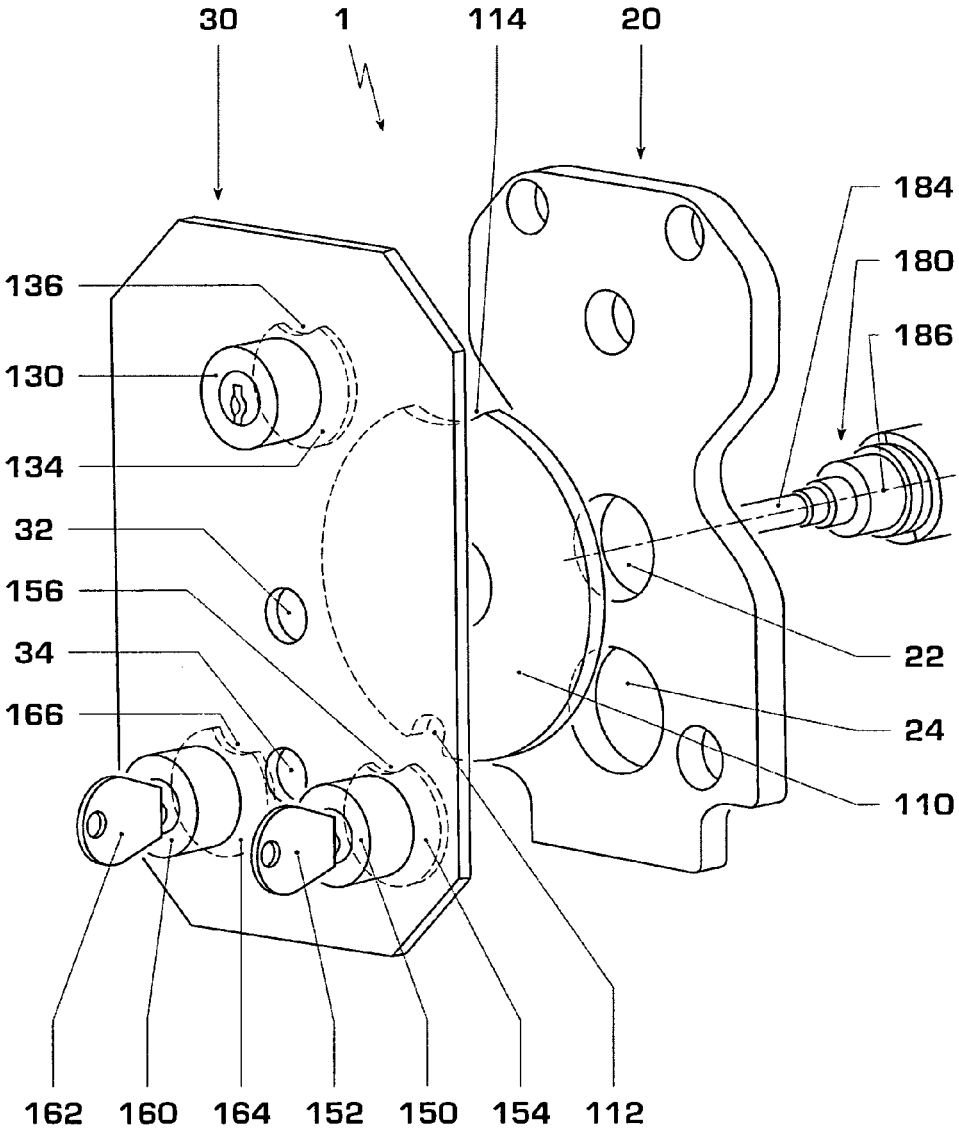
FIG. 1 shows a perspective, exploded view of a control unit according to the disclosure.

According to a first aspect of the disclosure, a control unit is provided for an electrical switching device. The control unit comprises: a control shaft which can rotate about a control axis for operating, i.e. for opening and closing of a moveable contact of the electrical switching device; a first blocking mechanism for the control shaft, which can be activated, i.e. can be switched to an active state, in order to block rotational movement of the control shaft in a first rotation direction; and an activation mechanism for the first blocking mechanism, which has means for activation of the first blocking mechanism and is therefore designed to activate the first blocking mechanism.

According to a further aspect of the invention, a locking system is provided for locking an access for an electrical switching device. The locking system comprises a setting shaft, which can rotate about a setting axis, for setting a plurality of setting states by selection of the rotation angle of the setting shaft, with the plurality of setting states comprising a first setting state and a second setting state; and a locking disk, which can rotate with the setting shaft, with at least one of the setting states being a locked setting state, and with at least one of the setting states being an unlocked setting state, and with the locking disk being designed to lock access to the operating system when a locked setting state occurs, and to allow access to the operating system when an unlocked setting state occurs. The invention also relates to a method for the production of the control unit and of the locking system.

Before describing the figures in detail, a number of general features of the control unit according to the disclosure and of the locking system according to the disclosure will first be described in more detail. For illustrative purposes, the reference symbols of the exemplary embodiment illustrated in FIGS. 1 to 7 will also be used in this general description. However, the general features are not restricted to the embodiment illustrated in the drawings, but can be combined individually in a modular fashion.

The control unit 1 has an operating system 200. Some of the features of the operating system 200 will be described in the following text. The control unit 1 comprises a control shaft 202, which can be rotated about a control axis 206 in order to operate a moveable contact in the electrical switching device. By way of example, the switching device may be an isolating switch, a load-break switch, a grounding switch, a fast-acting grounding device or a circuit breaker. In general, the contact is connected via a drive to the control shaft 202, and the drive is equipped to convert the rotary movement of the control shaft 202 to an operating movement of the contact in order to open and to close the switching device. The control shaft 202 is typically also coupled to an indicator for indicating the switching state. The control unit comprises further a first blocking mechanism 230, 330 for the control shaft 202, which can be activated in order to block any rotary movement of the control shaft 202 in a first rotation direction. The first blocking mechanism can therefore, in particular, assume an active and an inactive state, and in the active state it blocks the rotary movement of the control shaft 202 in the first rotation direction, while in the passive state it does not block it. The first blocking mechanism 230, 330 can be activated by an activation mechanism, i.e. it can be changed to the active state.

The control unit 1 typically also has a second blocking mechanism 240, 340, which can be activated in order, analogously to the first blocking mechanism, to block any rotary movement of the control shaft 202 in a second rotation direction, which is opposite to the first rotation direction. The activation mechanism can also activate the second blocking mechanism.

A first rotation state of the control shaft 202 typically defines a first switching state, for example the open or closed switching state or an intermediate state of the switching device, and a second rotation state of the control shaft 202 defines a second switching state of the switching device. The expression a rotation state means a rotation angle about the control axis, which also includes the number of revolutions relative to a given reference rotation state, that is to say it may be greater than 3600.

The control unit 1 typically also has a spindle drive 220, 222 with a spindle thread 220 arranged on one surface of the control shaft 202, and a spindle nut 222 which is threaded on the spindle thread 220. With a first position or a first position range of the spindle nut 222 is defined a first switching state of the switching device, and with a second position or a second position range of the spindle nut 222 is defined a second switching state of the switching device. The position of the spindle nut 222 is a translational position along the control axis. Therefore, as a rule the spindle drive 220, 222 links a respective rotation state of the control shaft 202 with a respective position of the spindle nut 222.

The first rotation direction is typically defined by the rotary movement of the control shaft 202 from the second switching state to the first switching state. The control shaft 202 typically has an access 212 for manual operation. The control shaft is typically coupled to a motor for motor-powered operation.

A number of features of the blocking mechanism 230, 330, 350 will be described in the following text. The first blocking mechanism 230, 330, 350 typically has a first ratchet wheel 230, which can rotate with the control shaft 202, and a first pawl 330, which is arranged such that it can engage in the first ratchet wheel 230 in order to block rotation of the control shaft 202 in the first rotation direction, by virtue of the engagement. A second blocking mechanism 240, 340, 350 of the control unit 1 typically has a second ratchet wheel 240, which can rotate with the control shaft 202, and a second pawl 340 which is arranged such that it can engage in the second ratchet wheel 240 in order to block rotation of the control shaft 202 in the second rotation direction, which is the opposite to the first rotation direction, by virtue of the engagement.

The first blocking mechanism 230, 330, 350 typically has a pawl prestressing element 350 in order to prestress the first pawl 330 in the direction of engagement with the first ratchet wheel 230 and, possibly, it may have a further pawl prestressing element 350 for prestressing the second pawl 340 in the direction of engagement with the second ratchet wheel 240. Alternatively, the two pawls 330, 340 can be prestressed by a single pawl prestressing element 350.

A number of features of the activation mechanism 310, 320 will be described in the following text. The activation mechanism 310, 320 is typically designed in order to activate the first blocking mechanism 230, 330, 350 when the first switching state occurs. It may possibly be designed in order to activate the second blocking mechanism 240, 340, 350 when the second switching state occurs. For example, the activation mechanism 310, 320 can interact with the spindle nut 222 such that the first blocking mechanism 230, 330, 350 is activated when the spindle nut 222 is in a position of the first rotation state of the control shaft 202 or the first switching state of the switching device, and such that the second blocking mechanism 240, 340, 350 is activated when the spindle nut 222 is in a position of the second rotation state of the control shaft 202, or the second switching state of the switching device.

The activation mechanism 310, 320 typically has a moveable first restraint part 317, which can be brought into contact with the first pawl 330 in order to restrain the first pawl 330 against the prestressing of the pawl prestressing element 350, so that the first pawl 330 does not engage in the first ratchet wheel 230, and the first blocking mechanism 230, 330, 350 is therefore not activated. The first restraint part 317 is then designed such that the contact between the first restraint part 317 and the first pawl 330 is released when the first movement state occurs, or when the spindle nut 222 is in a position of the first switching state, such that the first pawl 330 can engage in the first ratchet wheel 230, that is to say the first blocking mechanism 230, 330, 350 can be activated.

The activation mechanism 310, 320 may also analogously have a movable second restraint part 327, which can be brought into contact with the second pawl 340 in order to restrain the second pawl 340 against the prestressing of the pawl prestressing element 350, so that the second pawl 340 does not engage in the second ratchet wheel 240. The second restraint part 327 is then designed such that the contact between the second restraint part 327 and the second pawl 340 is released when the second movement state occurs, so that the second pawl 340 can engage in the second ratchet wheel 240.

The activation mechanism 310, 320 typically has a first bolt 310 with a first bolt prestressing element 314. The first bolt 310 can be moved to an inactive position and to an active position, and is designed in order to restrain any movement of the first pawl 330 in the direction of the first ratchet wheel 230, i.e. to block it, when it is in the inactive position, and in order to allow movement of the first pawl 330 in the direction of the first ratchet wheel 230, i.e. to release it, when it is in the active position. The first bolt prestressing element 314 then prestresses the first bolt 310 towards the inactive position. The activation mechanism 310, 320 typically also has a second bolt 320 with a second bolt prestressing element 324. The second bolt 320 is moveable to an inactive position and to an active position and is designed in order to restrain any movement of the second pawl 340 in the direction of the second ratchet wheel 240, i.e. to block it, when it is in the inactive position, and in order to allow movement of the second pawl 340 in the direction of the second ratchet wheel 240, i.e. to release it, when it is in the active position. The second bolt prestressing element 324 then prestresses the second bolt 320 towards the inactive position.

The first bolt 310 typically has a driver or a driving projection 312 which is arranged such that the spindle nut 222 can move the first bolt 310, by interaction with the driver 312, against the prestressing of the first bolt prestressing element 314, to the active position when the spindle nut 222 is in the first switching state. The second bolt 320 typically also has a driver 322, which is arranged such that the spindle nut 222 can move the second bolt 320, by interaction with the driver 322, against the prestressing of the second bolt prestressing element 324, to the active position when the spindle nut 222 is in the second switching state.

A first restraint part 317 may be formed by an area 317 of the first bolt 310 having a relatively large diameter or cross section. The first bolt 310 can then also have an area 316 with a smaller diameter than the area 317, and the first restraint part 317 can be arranged in order to restrain the movement of the first pawl 330 in the direction of the first ratchet wheel 230 when the first bolt 310 is in the inactive position. The area 316 with the smaller diameter can also be arranged in order to allow the movement of the first pawl 330 in the direction of the first ratchet wheel 230 when the first bolt 310 is in the active position.

A second restraint part 327 can be formed analogously by an area 327 on the second bolt 310. The second restraint part 327 can be arranged in order to restrain the movement of the second pawl 340 in the direction of the second ratchet wheel 240 when the second bolt 320 is in the inactive position. The area 326 with the smaller diameter can also be arranged in order to allow the movement of the second pawl 340 in the direction of the second ratchet wheel 240 when the second bolt 320 is in the active position. The first bolt 310 and the second bolt 320 can be arranged parallel to one another, and can be prestressed in opposite directions.

The control device 1 may have a locking system 100 for locking an access 212 for an electrical switching device. The locking system 100 may alternatively be provided individually. A number of features of this locking system 100 will be described in the following text. The locking system 100 comprises a setting shaft 180 which is rotatable about a setting axis 186, for setting a plurality of setting states 93, 94, 95, 96 by selection of the rotation angle of the setting shaft 180, with the plurality of setting states comprising at least one first setting state 95 and second setting state 96; and a locking disk 110 which is rotatable together with the setting shaft 180. At least one setting state from the plurality 93, 94, 95, 96 is a locked setting state 93, 95, 96, and at least one setting state from the plurality is an unlocked setting state 94. The locking disk 110 is designed to lock the access 212 to the operating system 200 when a locked setting state 93, 95, 96 occurs, and to allow access 212 to the operating system 200 when an unlocked setting state 94 occurs. The locking disk 110 typically has a cutout 112, which allows access 212 to the operating system 200 in the unlocked setting state 94.

At least one of the setting states 93, 94, 95, 96 is typically a lock-secured setting state 93, 95, 96, i.e. it is secured by a lock, which can be locked, such that this state can be left only when the lock is open. At least one setting state or a plurality of setting states is or are typically lock-secured by a respective lock 130, 150, 160, which can be closed and opened by means of a respective key (keys 152, 162 are shown), and which blocks rotation of the setting shaft 180, e.g., by interaction with the locking disk 110, when the lock-secured state occurs and the lock 130, 150, 160 is locked. This means that the lock 130, 150, 160 must be opened in order to leave the lock-secured state 93, 95, 96. The plurality of lock-secured states 93, 95, 96 can be locked states 93, 95, 96. The at least one lock 130, 150, 160 typically has a respectively associated key (keys 152, 162 are shown) for operation, i.e. for opening and/or for closing, the lock, which key can be removed from the respective lock when the lock is locked, and cannot be removed from the respective lock when the lock is open. The at least one lock 130, 150, 160 typically interacts with the locking disk 110 in such a way that the at least one lock 130, 150, 160 or even each lock must be opened in order to change from the at least one locked state 93, 95, 96 to the unlocked state.

The locking disk 110 typically has a blocking section 114, and the at least one lock 130, 150, 160 is then designed in order to engage in the blocking section 114 and in this way to prevent rotation of the locking disk 110, when it is locked, and in order to allow access to the blocking section 114 and thus to allow rotation of the locking disk 110, when it is open.

The setting shaft 180 may have a cam 194 which is arranged in order to operate a switch when the setting shaft 180 assumes a defined setting state 93.

The access is generally an access for manual operation of a moveable contact of the electrical switching device. The plurality of setting states may comprise the following setting states: a locked setting state 93 for automatic operation of the moveable contact, an unlocked setting state 94 for manual operation of the moveable contact, and two locked setting states 95, 96 for blocking the moveable contact in the open 95 and closed 96 switching state of the switching device, respectively.

The operating unit may have a setting shaft 180 which is rotatable about a setting axis 186, with a first and a second rotation angle of the setting shaft 180 about the setting axis 186 respectively defining a first and a second setting state 95, 96.

A number of features which relate to the effect of the locking system 100 on the operating system 200 will be described in the following text. The activation mechanism 310, 320, 361, 362 is typically designed and provided with means in order to activate the first blocking mechanism 230, 330, 350 when the first setting state occurs. Furthermore, it is typically designed in order to activate the second blocking mechanism 240, 340, 350 when the second setting state occurs. The activation mechanism 310, 320, 361, 362 can therefore activate the first blocking mechanism 230, 330, 350 and, possibly, the second blocking mechanism 240, 340, 350 as a function of the respective rotation angle of the setting shaft 180.

The activation mechanism 310, 320, 361, 362 typically has a first bolt pusher 361, which is suitable for pushing the first bolt 310 against the prestressing as a function of the rotation angle of the setting shaft 180. It typically has a second bolt pusher 362, which is suitable for pushing the second bolt 320 against the prestressing as a function of the rotation angle of the setting shaft 180. The first bolt pusher 361 can be designed to press the first bolt 310 to the active position, against the prestressing of the first bolt prestressing element 314, when the first setting state occurs. The second bolt pusher 362 can be designed to press the second bolt 320 to the active position, against the prestressing of the second bolt prestressing element 324, when the second setting state occurs.

The first bolt pusher 361 typically has an end surface 361 which can rotate with the setting shaft 180 and is arranged at an inclined angle with respect to the setting axis 186, so that the end surface 361 can move the first bolt 310, against the prestressing of the first bolt prestressing element 314, to the active position, when the first setting state occurs. The end surface 361 can typically move or push the first bolt 310 to the active position by interaction with a driver. The first bolt pusher 361 or the end surface 361 can typically move the first bolt 310 to the active position as a function of a setting state of the setting axis 186.

The second bolt pusher 362 typically analogously has an end surface 362 which can rotate with the setting shaft 180 and is arranged at an inclined angle with respect to the setting axis 186, so that the end surface 362 can move the second bolt 320 to the active position, against the prestressing of the second bolt prestressing element 324, when the second setting state occurs. The end surface 362 can typically move or push the second bolt 320 to the active position by interaction with a driver. The second bolt pusher 362 or the end surface 362 can typically move the second bolt 320 to the active position as a function of a setting state of the setting axis 186.

The locking system 100 may in each case allow a plurality of setting states to be set, and the operating system 200 may define a plurality of operating states. The set of all the operating states which can be achieved in a first setting state may then differ from the set of all the operating states which can be achieved in a second setting state. The set of all the setting states which can be achieved in a first operating state may also differ from the set of all the setting states which can be achieved in a second operating state.

A number of features which relate to the effect of the operating system 200 on the locking system 100 will be described in the following text.

The control unit 1 typically has a setting blocking mechanism 226, 196,197 which is designed to block any rotation of the setting shaft 180 towards the first setting state 95 when a switching state other than the first occurs, that is to say when not in the first switching state. The control unit 1 typically also has a setting blocking mechanism 226,196,197 which is designed to block any rotation of the setting shaft 180 towards the second setting state 96 when a switching state other than the second occurs.

The setting blocking mechanism 226, 196,197 typically has a first cam 196 on the setting shaft 180 and a blocking piece 226 which is attached to the spindle nut 222. The first cam 196 then extends, e.g., along the setting axis 186, along a first blocking area or blocking range, which is associated with translational movement of the blocking piece 226 outside the first movement state, and the first cam 196 is shaped such that any rotation of the setting shaft 180 towards the first setting state 95 is blocked by a stop on the first cam 196 on the blocking piece 226 when the blocking piece 226 is in the first blocking area. The blocking piece 226 is typically formed integrally with the spindle nut 222.

The setting blocking mechanism 226, 196,197 typically also has a second cam 197 on the setting shaft 180, and a blocking piece which is attached to the spindle nut 222 and may be formed in the same way as the said blocking piece 226, or be formed integrally with it, or may differ from it. The second cam 197 can extend along the setting axis 186, along a second blocking area which is associated with the translational movement of the blocking piece 226 outside the second movement state, and the second cam 197 is shaped such that any rotation of the setting shaft 180 towards the second setting state 96 is blocked by a stop on the second cam 197 on the blocking piece 226 when the blocking piece 226 is in the second blocking area.

A control unit 1 according to the disclosure will now be described in more detail in the following text, by way of example, with reference to FIGS. 1 to 7. In these figures, identical or functionally similar parts are annotated with the same reference symbols.

FIG. 1 shows a perspective exploded view of a front part of the control unit 1. The control unit 1 comprises: a setting shaft 180 with a front piece 184; a front panel 20; a locking disk 110; and a panel 30 with locks 130, 150 and 160. The front panel 20 has an opening 22 through which the front piece 184 of the setting shaft 180 extends, and a further opening 24 which allows access for an operating system (see below). The setting shaft 180 can rotate about a setting axis 186. This is part of a locking system, which will be described further below. The setting shaft 180 is connected to the locking disk 110, and can rotate together with it.

The locking disk 110 is essentially circular and has two cutouts 112 and 114. The radius of the locking disk 110 is larger than the distance between the setting axis 186 and the access for the operating system (opening 24). The locking disk 110 can therefore block the access for the operating system. However, the locking disk 110 can be rotated such that the cutout 112 releases the access for the operating system. A locked or an unlocked setting state therefore occurs depending on the rotation angle of the locking disk 110, to be precise of the setting shaft 180 about the setting axis 186.

Figure 2:
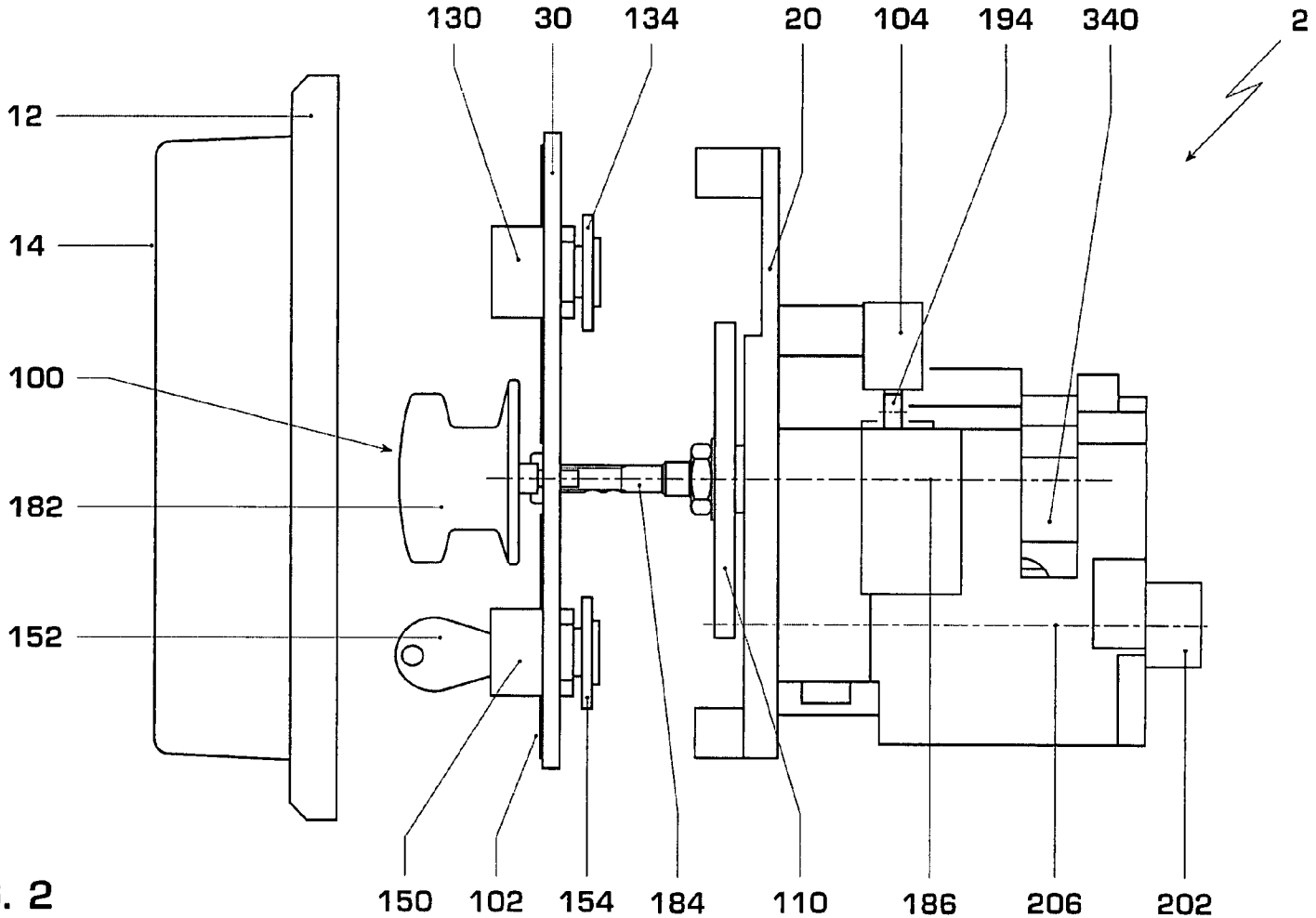
FIG. 2 shows a side view of the control unit.

The panel 30 has an opening 32 for the setting shaft 180, and an opening 34 for the operating system. The openings 32 and 34 are coaxial to the respective openings 22 and 24 in the front panel 20. As is shown in FIG. 2, a setting rotary knob 182 is firmly connected to the front piece (which is passed through the opening 32) of the setting shaft 184. The setting rotary knob 182 has a pointer, which points in the direction of the cutout 114.

Figure 3:
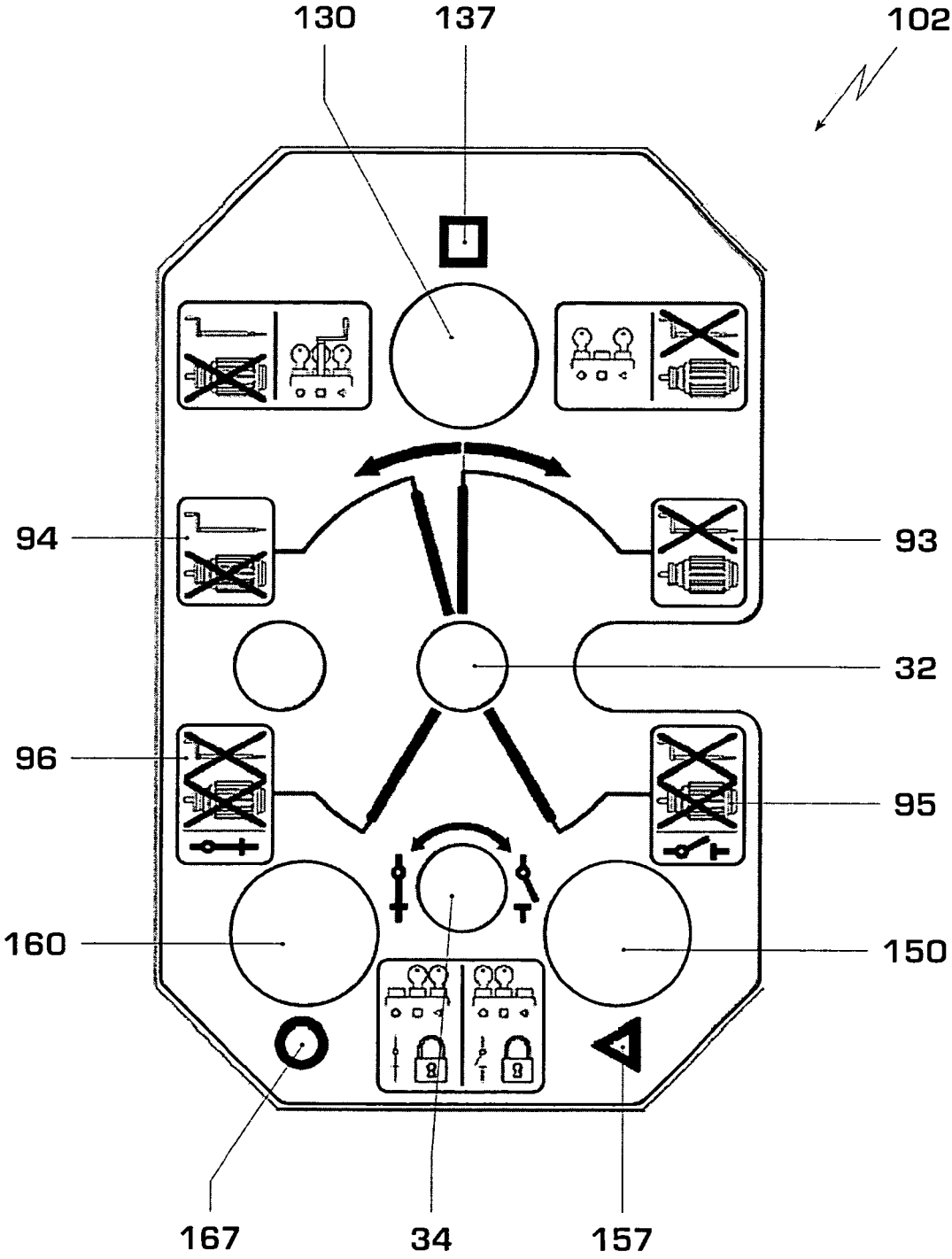
FIG. 3 shows an inscription for a panel for the control unit.

Different rotation angles of the setting shaft 180 and therefore setting states of the control unit 1 can be set by rotation of the setting rotary knob 182, and therefore of the setting shaft 184 and of the blocking disk 110. By way of example, FIG. 3 shows an inscription 102 for the panel 30. The inscription 102 in each case associates four different rotation angles of the setting shaft 180 and of the setting rotary knob 182 with one of the four following setting states:

- a setting state 94 for manual operation of the moveable contact;
- a setting state 93 for automatic operation of the moveable contact, and
- two setting states 95, 96 for blocking the moveable contact with the switching device being in the open and closed switching state, respectively.

The setting state 94 allows access to the operating system 1 through the cutout 112 in the locking disk 110, that is to say the setting state 94 is an unlocked state. No access is allowed in the other setting states 93, 95, 96, that is to say they are locked states.

In the setting state 93, a limit switch for the drive motor of the electrical switching device is switched on, that is to say motor-driven operation is possible. In the other setting states 94, 95, 96, the limit switch is interrupted, and motor-driven operation is not possible. As is shown in FIG. 2 and in FIG. 4, the limit switch 104 is operated by a cam 194 on the setting shaft 180. The cam 194 is arranged such that the limit switch 104 is switched on only when the setting shaft 180 assumes the setting state 93.

FIG. 1 shows further locks 130, 150 and 160. The locks are respectively equipped with a key disk 134, 154 and 164. The key disks are in the form of circular segments and have a respective cutout 136, 156 and 166.

The lock 130 is shown in a locked state: the locked state is defined by the cutout 136 of the lock 130 being rotated away from the control disk 110, and the key disk 134 therefore engaging in the cutout 114 in the lock disk 110. The lock 130 can therefore be locked only in the setting state 93, in which the cutout 114 in the locking disk 110 is rotated toward the lock 130. When the lock 130 is locked, this setting state 93 is then blocked by the key disk 134 engaging in the cutout 114, and this state cannot be left. The setting state 93 can be left only when the lock has been opened and the cutout 136 has been rotated with respect to the locking disk. In other words, the setting state 93 is lock-secured by the lock 130.

The setting states 95, 96 are lock-secured analogously by further locks 150, 160. The further locks 150, 160 are illustrated in the open state, i.e. the cutouts 156, 166 are rotated towards the locking disk 110. Keys 152, 162 are also illustrated, and are required to lock and to open the locks 150, 160. The keys 152, 162 can be removed from the respective lock 130, 150 and 160 only when the lock is locked. If the keys are clearly identified, it can therefore be seen from the presence of a key which has been removed from the lock 130, 150, 160 that the respective setting state 93, 95 or 96 has occurred. If there is no removed key, the setting state 94 could occur, which is the only one which is not lock-secured. By way of example, the keys could be identified by respective geometric symbols 137, 157, 167, as illustrated for the locks 130, 140 and 160 in FIG. 3.

The lock-secured states 93, 95, 96 are locked states (see above). All three locks 130, 150, 160 must therefore be open in order to change to the unlocked state 94. In particular, all three associated keys must be present. The locks in FIG. 1 could also be provided in a different manner, for example by bolt locks, or else could be omitted.

FIG. 2 shows a side view of the control unit 1. This illustrates a front panel 12 with a glass pane 14, in addition to the elements described in conjunction with FIG. 1. A control shaft 202 is also shown, and can be rotated about a control axis 206 (see FIG. 4).

Figure 4:
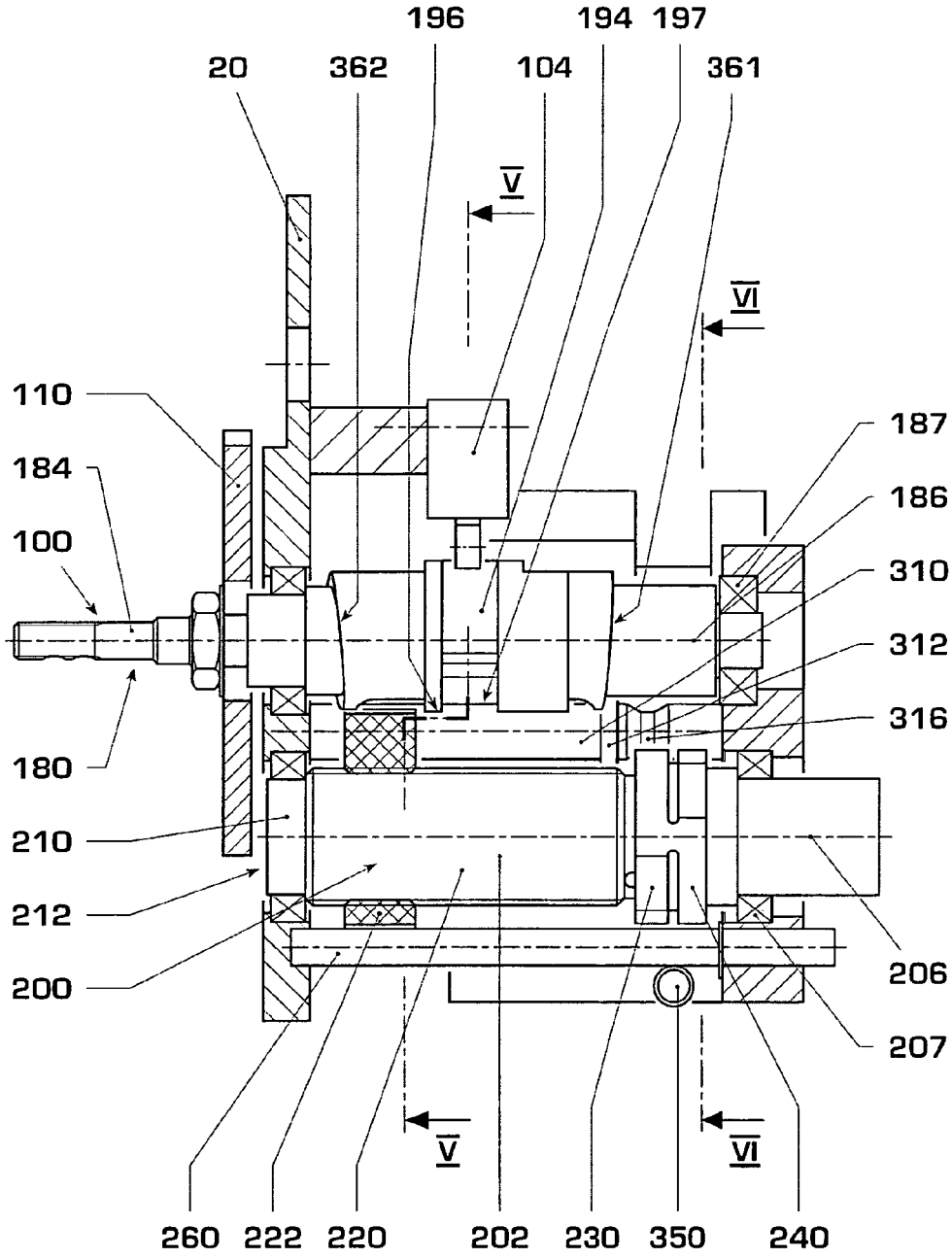
FIG. 4 shows a vertical longitudinal section through the control unit.

FIG. 4 shows a vertical longitudinal section through the control unit. This shows the following further elements of the setting shaft 180, in addition to the elements described with reference to FIGS. 1 and 2: bearing 187 for the bearing (which can rotate about the setting axis 186) for the setting shaft 180; cams 196, 197; and inclined end surfaces 361 and 362. FIG. 4 illustrates the following further elements of the operating system 200: a control shaft 202 which is mounted by means of bearings 207 such that it can rotate about a control axis 206. The control shaft 202 is connected via a drive to a moveable contact of the electrical switching device. A front piece 210 of the control shaft 202 has a crank socket 212 for a hand crank. The crank socket 212 represents the access to the operating system, that is to say the access for manually driving the operating system, which, as described with reference to FIG. 1, can be locked by the setting system 100.

The switching device can be operated manually by the hand crank in the setting state 94 (see FIG. 3) or by a motor in the setting state 93 (see FIG. 3). In both cases, any rotation of the control shaft 202 is coupled to operation of the switching device, and each rotation state of the control shaft 202 is uniquely linked to a respective switching state (for example the open or closed switching state) of the switching device. The control shaft 202 is also coupled to an indication, which indicates the switching state ("switch open", "switch closed" or an intermediate state).

Furthermore, a spindle thread 220 is illustrated, and is arranged on the surface of the control shaft 202. A spindle nut 222 is threaded onto the spindle thread 220. A guide rod 260 prevents any rotary movement of the spindle nut 222 about the control axis 206. This results in a spindle drive 220, 222, 260 being formed which uniquely associates each position of the spindle nut 222 with the respective rotation state of the control shaft 202, and therefore with a respective switching state of the switching device. In particular, a first position in an edge area of the spindle thread 220 on one side of the front piece 210 defines an open switching state of the switching device, and a second position in an edge area of the spindle thread 220 on the side of the ratchet wheels 230, 240 defines a closed switching state of the switching device. The positions between these edge areas define intermediate states of the switching device. A blocking mechanism, which will be described further below, prevents the spindle nut assuming positions outside these ranges. Two contra-rotating ratchet wheels 230, 240 are also attached concentrically to the control shaft 202 and can rotate together with it. A bolt 310, which has a notch 316, is also illustrated. These elements will be described in more detail with reference to FIG. 7.

Figure 5:
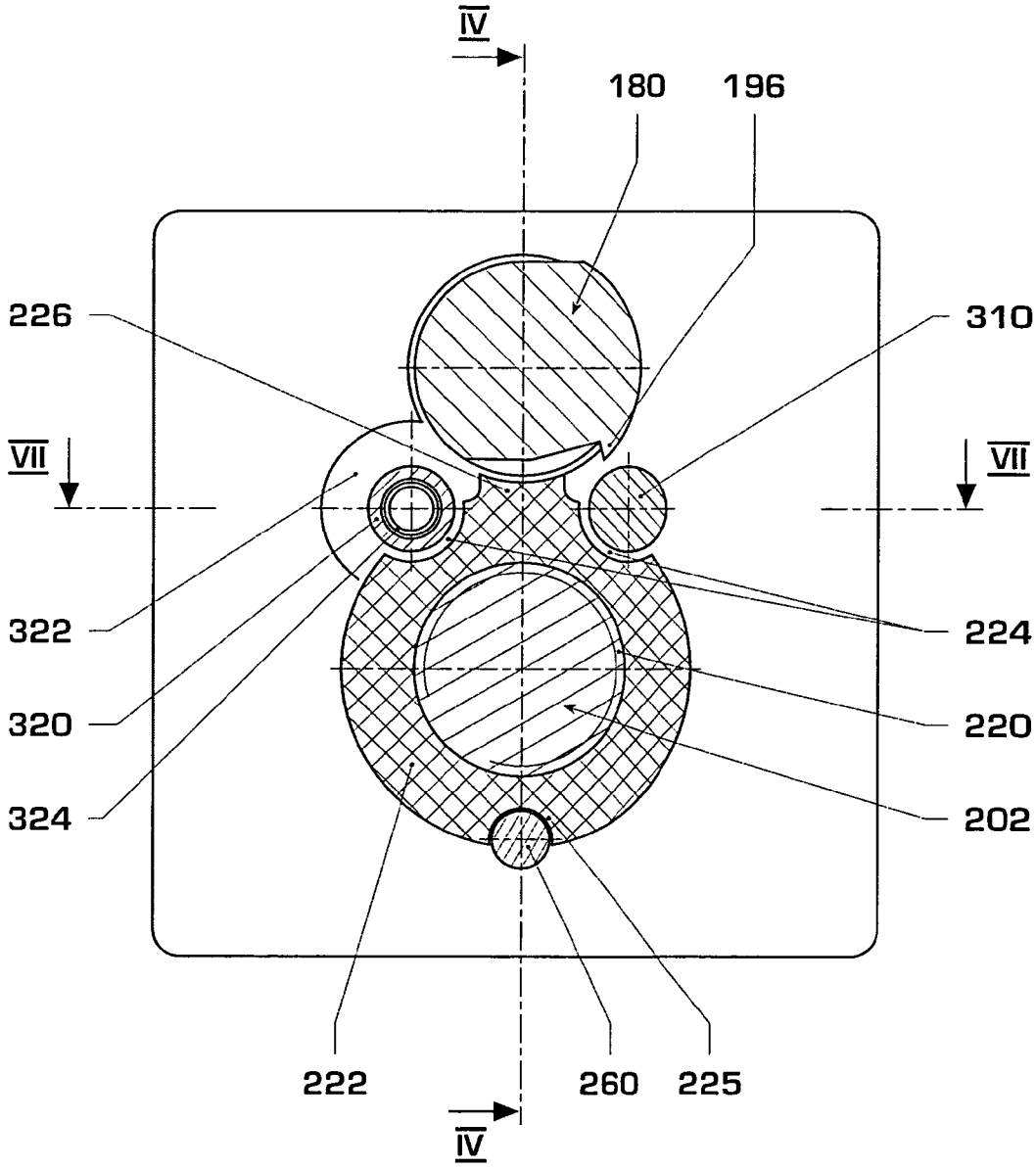
FIG. 5 shows a cross section through the control unit.

FIG. 5 shows a cross section through the control unit along the plane V-V illustrated in FIG. 4. This once again shows the spindle drive 220, 222, 260, which comprises the spindle thread 220, the spindle nut 222 and the guide rod 260. The guide rod 260 engages in a cutout 225 in the spindle nut 222, in order to prevent rotation of the spindle nut 222. The spindle nut 222 has a blocking piece 226, which is in the form of a projection. The setting shaft 180 has a cam 196 which is designed such that, together with the blocking piece 226, it forms a stop which limits rotation of the setting shaft 180 in the clockwise direction. The stop thus blocks any rotation of the setting shaft 180 towards the setting state 96 (see FIG. 3). The cam 196 is formed in a longitudinal area or range along the setting axis 184 (that is to say at right angles to the plane of the drawing in FIG. 5), defining a blocking area for the translational movement of the blocking piece 226 along the spindle drive. When the blocking piece 226 is in the blocking area, then the stop is formed. The blocking area is designed such that it covers all those reachable positions of the blocking piece 226 which are not associated with the switching device being in the closed switching state. In other words, the blocking area is designed such that a stop is provided between the cam 196 and the blocking piece 226 for each position of the spindle nut 222, with the exception of the position of the spindle nut 222 which is linked to the closed switching state of the switching device. The stop between the cam 196 and the blocking piece 226 therefore defines a setting blocking mechanism, which blocks rotation of the setting shaft 180 towards the setting state 96 ("switch closed") when a switching state other than the "switch closed" switching state occurs.

A further cam 197 (FIG. 4) is formed analogously for engagement with the blocking piece 226 which is designed as a horizontal mirror-image of the cam 196. The further cam 197 together with the blocking piece 226 forms a stop which blocks any rotation of the setting shaft 180 in the counter-clockwise direction with respect to the setting state 95. The further cam 197 is formed in a longitudinal area along the setting axis 186 (i.e. at right angles to the plane of the drawing) and thus defines a blocking area which is designed such that it covers all those reachable positions of the blocking piece 226 which are not associated with the switching device being in the open switching state. Since the section plane V-V in FIG. 5 is outside this longitudinal range, the further cam 197 is not illustrated in it.

A further bolt 320 is illustrated at the side, alongside the bolt 310, that has already been illustrated in FIG. 4. The two bolts 310, 320 have a driver projection. Since the driver projection on the bolt 310 is located behind the section plane V-V only the driver projection 322 on the bolt 320 is illustrated. The spindle nut 222 has cutouts 224 for the bolts 310, 320. The cutouts 224 prevent any overlap between the cross sections of the spindle nut 222 and the bolts 310, 320. The cross sections of the spindle nut 222 and of the driver projection 312, 322 overlap one another, however.

Figure 6:
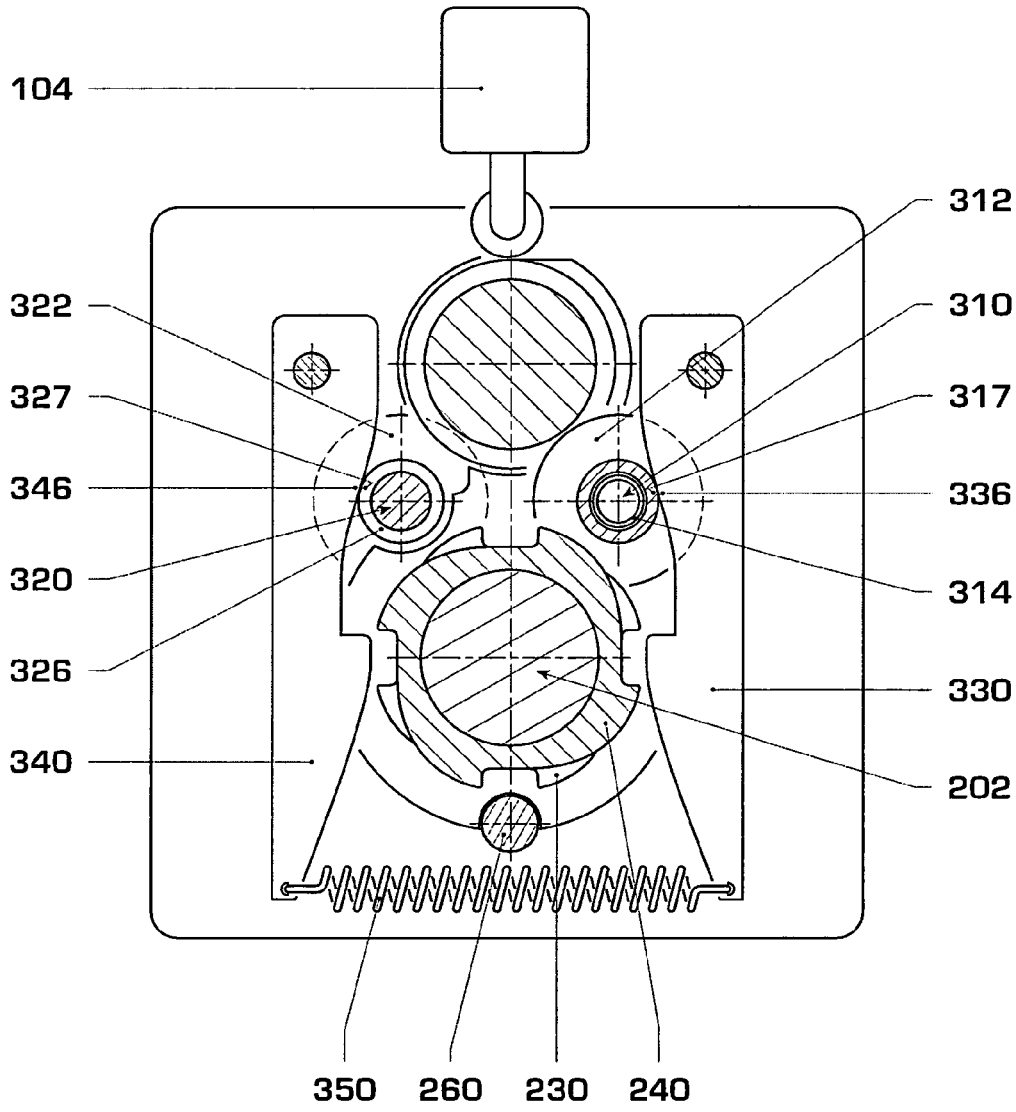
FIG. 6 shows a further cross section through the control unit.

FIG. 6 shows a further cross section through the control unit on the section plane VI-VI (see FIG. 4). Ratchet wheels 230, 240 and pawls 330, 340 are shown in this figure. The ratchet wheel 230 and the pawl 330 are laterally offset with respect to the ratchet wheel 240 and the pawl 340, so that the pawl 230 can engage in the ratchet wheel 230 in order to block the rotation of the control shaft 202 in a blocking direction in the clockwise direction and such that the pawl 340 can engage in the ratchet wheel 240 in order to block the rotation of the control shaft 202 in a blocking direction in the counter clockwise direction. The engagement of the pawls 330, 340 in the respective ratchet wheels 230, 240 therefore in each case provides a blocking mechanism for rotation of the control shaft 202 in one direction in each case.

A common spring 350 stresses both pawls 330 and 340 in the direction of the respective ratchet wheels 230 and 240. Although the common spring 350 represents a particularly space-saving solution, it can also be replaced by other pawl prestressing elements 350 for the respective pawls 330 and 340, for example by individual tension springs or compression springs in each case.

Furthermore, the bolts 310 and 320 (see FIG. 5) and their respective driver projections 312 and 322 are illustrated by dashed lines. A restraint part 317 of the bolt 310 touches a contact part 336 of the pawl 330. This contact results in the pawl 330 being restrained against the prestressing of the tension spring 350 so that it cannot engage in the ratchet wheel 230. In the same way, the pawl 340 is restrained by the contact of a restraint part 327 of the bolt 320 with a contact part 346 of the pawl 340, so that it cannot engage in the ratchet wheel 240.

Figure 7:
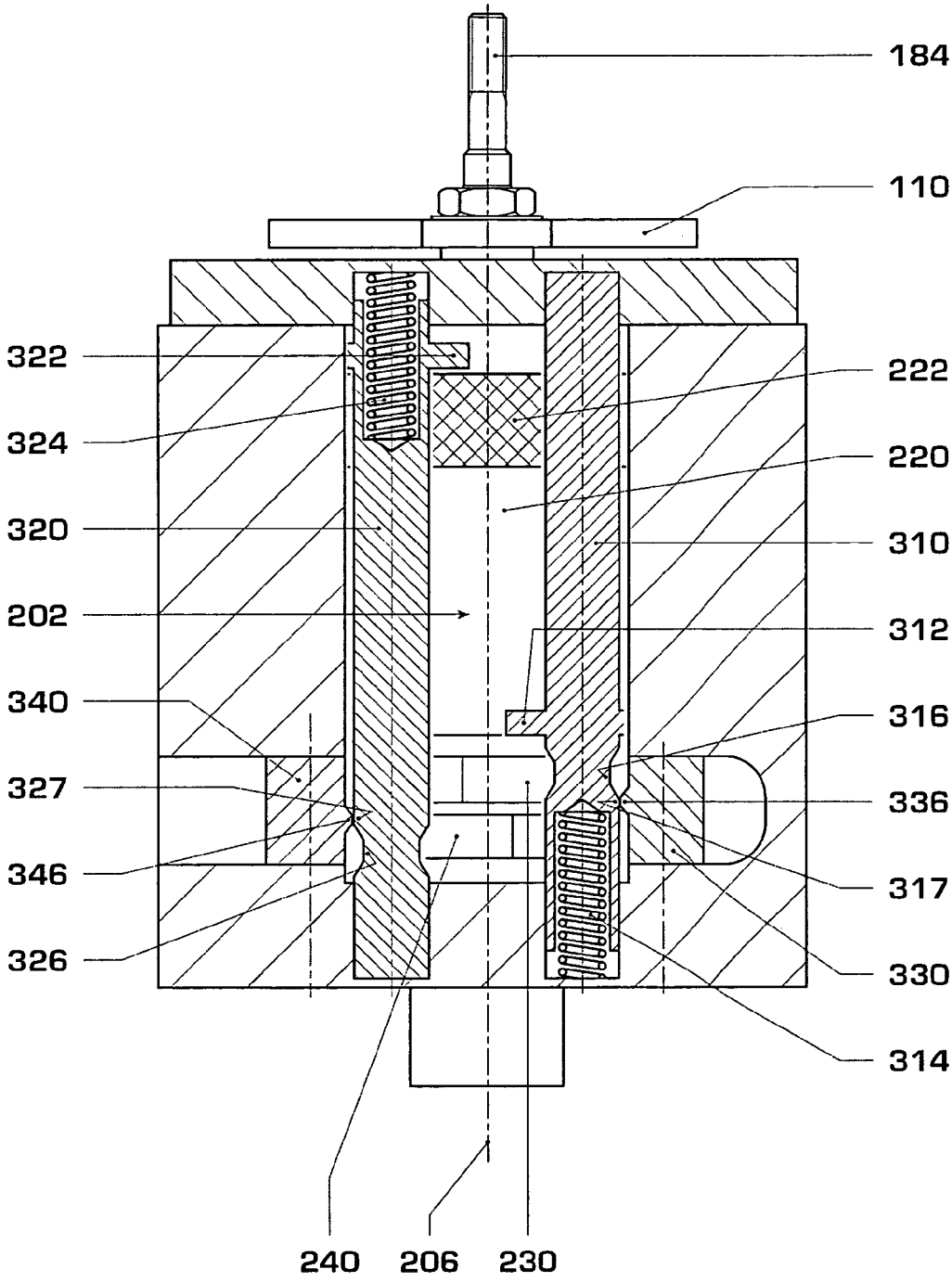
FIG. 7 shows a horizontal longitudinal section through the control unit.

FIG. 7 shows a horizontal longitudinal section through the control unit along the section plane VII-VII (see FIG. 5). This once again shows the control shaft 202 with the spindle thread 220 and the spindle nut 222. The ratchet wheels 230, 240 and the pawls 330, 340 with the contact parts 336, 346 are also illustrated. In addition, the bolts 310, 320 are illustrated. The restraining part 317 of the bolt 310 is formed by an area with a larger diameter. The bolt 310 has an area 316 with a smaller diameter. FIGS. 6 and 7 show the bolt 310 in a position which is also referred to as the inactive position. In this position, the restraint part 317 blocks the movement of the pawl 330 in the direction of the ratchet wheel 230, as has been described with reference to FIG. 6. The bolt 320 is likewise illustrated in a corresponding inactive position.

FIG. 7 shows that the bolt 310 is moveable in the direction away from the locking disk 110 along its axis, i.e. parallel to the control axis 206. This allows the bolt 310 to be moved to a position in which the area with the larger diameter 317 does not make contact with the contact part 336 of the pawl 330, and therefore does not block the movement of the pawl 330 in the direction of the ratchet wheel 230. Instead of this, the area 316 with the smaller diameter allows the pawl 330 to move in the direction of the ratchet wheel 230. This position is also referred to as the active position. A spring 314 prestresses the bolt 310 in the direction of the locking disk, i.e. towards the inactive position.

With respect to the pawl 340, the bolt 320 corresponds to the bolt 310. The arrangement of the bolt 320 is essentially a mirror image of the arrangement of the bolt 310. The inactive position of the bolt 320 is therefore in the direction away from the locking disk 110, and its active position is in the direction towards the locking disk 110. The bolt 320 is also prestressed by a spring 324 to the inactive position, i.e. in the opposite direction to the bolt 310.

As can be seen from FIG. 7, the driver projection 322 in the bolt 320 is arranged such that the spindle nut 222 can press the bolt 320 against the prestressing of the bolt prestressing element 324 to the active position, by interaction with the driver projection 322. This is because the spindle nut 222 presses the bolt 320 towards the active position when it is being moved even further than shown in FIG. 7 in the direction of the locking disk 110. The position of the spindle nut 222, in which it presses the bolt prestressing element 324 towards the active position, corresponds to the "switch open" switching state. When this position, which may also be a position range, occurs, the pawl 340 can therefore engage in the ratchet wheel 240. The bolt 320 therefore represents an activation mechanism 320, which can activate the blocking mechanism, which is represented by the pawl 340 and the ratchet wheel 240, when it is moved to an active position. This can be done as described above, when the spindle nut 222 reaches a position which corresponds to the "switch open" switching state. In other words, the activation mechanism 320 interacts with the spindle nut 222 such that the blocking mechanism 240, 340 is activated when the spindle nut 222 is in a position corresponding to the "switch open" switching state. When the blocking mechanism 240, 340 is activated, it blocks any rotation of the control shaft 202 in a direction which would move the spindle nut 222 further towards the locking disk 110, that is to say in the rotation direction which lead to the activation of the blocking mechanism 240, 340. The combination of the described blocking mechanism 240, 340 and activation mechanism 320 therefore provides a stop which prevents further rotation of the control shaft 202 and further movement of the spindle nut 222 which would go beyond the "switch open" switching state.

The bolt 310 analogously forms an activation mechanism 310 which can activate the blocking mechanism, as represented by the pawl 330 and the ratchet wheel 230, when it is moved to an active position. This occurs when the spindle nut 222 reaches a position close to the ratchet wheels 230, 240, which corresponds to the "switch closed" switching state. This provides a stop which prevents further rotation of the control shaft 202 and further movement of the spindle nut 222 which would go beyond this switching state.

The activation mechanism 310, 320 which is formed by the bolts 310 and 320 can not only interact, as described above, with the spindle nut 222 and with the operating system 200, respectively. It can also interact with the setting system 100, as will be described in the following text with reference to FIG. 4. This figure shows an end surface 361 which can rotate with the setting shaft 180 and is arranged at an inclined angle with respect to the setting axis 186. The position and the inclined angle of the end surface 361 are selected such that the end surface 361 can press the driver 312 as a function of the rotation angle of the setting shaft 180, and can thus move the bolt 310 to the active position. In particular, the end surface 361 can force the bolt 310 to the active position, when the setting state 95 or 96 occurs (see FIG. 3) and allow its inactive position when the setting state 93 or 94 occurs. A further end surface 362, which can rotate with the setting shaft 180, is illustrated, which can press the driver 322 of the bolt 320 as a function of the rotation angle of the setting shaft 180, and can thus result in an analogous effect for the bolt 320.

When the bolts 310 and 320 are in the active position, the blocking mechanism, which has been described with reference to FIG. 7 and is formed by the respective ratchet wheels 230, 240 and the respective pawls 330, 340, is activated. This makes it possible to ensure that the control shaft 202 and therefore the switch of the electrical switching device cannot be moved, that is to say they cannot be moved in either of the two possible rotation directions, in the setting states 95 or 96.

The blocking piece 226 which has been described with reference to FIG. 5 ensures that the setting state 95 can be reached only in "switch open" switching state. In this case, the spindle nut 222 is in a position which presses the bolt 320 towards the active position. Since the bolt 320 is therefore in any case already in the active position, the end surface 362 has no effect for the setting state 95. In a corresponding manner, the end surface 361 has no effect for the setting state 96. Without significantly changing the method of operation of the control unit, the end surface 361 could therefore alternatively be designed such that it moves the bolt 310 to the active position only in the setting state 95, and the end surface 362 could be designed such that it moves the bolt 320 to the active position only in the setting state 96.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A control unit for an electrical switching device, comprising a control shaft which can be rotated about a control axis such that rotary movement of the control shaft can open or close a moveable contact of the electrical switching device, a first blocking mechanism for the control shaft, for activating in order to block a rotary movement of the control shaft in a first rotation direction, the first blocking mechanism having a first axis of rotation, and an activation mechanism for the first blocking mechanism, which has means for activation of the first blocking mechanism, the activation mechanism having a second axis of rotation different from the first axis of rotation.

2. The control unit as claimed in claim 1, further comprising a second blocking mechanism for activating in order to block a rotary movement of the control shaft in a second rotation direction, which is the opposite of the first rotation direction, and with the activation mechanism having means for activation of the second blocking mechanism.

3. The control unit for an electrical switching device as claimed in claim 1, with a first rotation state of the control shaft defining a first switching state of the switching device, and with a second rotation state of the control shaft defining a second switching state of the switching device.

4. The control unit as claimed in claim 3, with the activation mechanism being designed to activate the first blocking mechanism when the first switching state occurs.

5. The control unit as claimed in claim 3, with the activation mechanism being designed to activate the second blocking mechanism when the second switching state occurs.

6. The control unit for an electrical switching device as claimed in claim 1, furthermore having a spindle drive with a spindle thread arranged on one surface of the control shaft, and with a spindle nut which is threaded on the spindle thread, with a first position or a first position range of the spindle nut defining a first switching state of the switching device, and with a second position or a second position range of the spindle nut defining a second switching state of the switching device.

7. The control unit as claimed in claim 1, with the control shaft having an access for manual operation, and with the control shaft being coupled to a motor for motor-driven operation.

8. The control unit as claimed in claim 1, with the first blocking mechanism comprising:

a first ratchet wheel which is rotatable together with the control shaft, and a first pawl which is arranged such that it is engageable in the first ratchet wheel in order to block rotation of the control shaft in the first rotation direction, by virtue of the engagement.

9. The control unit as claimed in claim 6, with a second blocking mechanism comprising:

a second ratchet wheel which is rotatable together with the control shaft, and a second pawl which is arranged such that it is engageable in the second ratchet wheel in order to block rotation of the control shaft in the second rotation direction, which is the opposite to the first rotation direction, by virtue of the engagement.

10. The control unit as claimed in claim 9, with the second blocking mechanism having a pawl prestressing element for prestressing the second pawl in the direction of the engagement with the second ratchet wheel.

11. The control unit as claimed in claim 9, furthermore comprising a setting shaft which is rotatable about a setting axis, with a first and a second rotation angle of the setting shaft about the setting axis respectively defining a first and a second setting state.

12. The control unit as claimed in claim 11, with the activation mechanism activating the first blocking mechanism when the first setting state occurs.

13. The control unit as claimed in claim 11, with the activation mechanism activating the second blocking mechanism when the second setting state occurs.

14. The control unit for an electrical switching device as claimed in claim 11, furthermore comprising a setting blocking mechanism for blocking rotation of the setting shaft towards the first setting state when a switching state other than the first occurs.

15. The control unit as claimed in claim 14, with the control shaft having an access for manual operation, with the control shaft being coupled to a motor for motor-driven operation, and with the setting blocking mechanism comprising a first cam on the setting shaft and a blocking piece which is attached to a spindle nut, with a first cam extending along a first blocking area, which is associated with translation movement of the blocking piece outside a first movement state, and with the first cam being shaped such that rotation of the setting shaft towards the first setting state is blocked by a stop of the first cam on the blocking piece when the blocking piece is in the first blocking area.

16. The control unit as claimed in claim 14, with the control shaft having an access for manual operation, with the control shaft being coupled to a motor for motor-driven operation, and with the setting blocking mechanism having a second cam on the setting shaft and a blocking piece which is attached to a spindle nut, with a second cam extending along a first blocking area, which is associated with translation movement of the blocking piece outside a second movement state, and with the second cam being shaped such that rotation of the setting shaft towards the second setting state is blocked by a stop of the second cam on the blocking piece when the blocking piece is in the second blocking area.

17. The control unit for an electrical switching device as claimed in claim 11, further comprising a setting blocking mechanism for blocking rotation of the setting shaft towards the second setting state when a switching state other than the second occurs.

18. The control unit as claimed in claim 8, with the first blocking mechanism having a pawl prestressing element for prestressing the first pawl in the direction of the engagement with the first ratchet wheel.

19. The control unit as claimed in claim 8, with the activation mechanism having a moveable first restraint part, which can be brought into contact with the first pawl in order to restrain the first pawl against the prestressing of the pawl prestressing element, such that the first pawl does not engage in the first ratchet wheel, with the first restraint part being designed such that the contact between the first restraint part and the first pawl is released when the first movement state occurs, so that the first pawl can engage in the first ratchet wheel.

20. The control unit as claimed in claim 8, with the activation mechanism having a moveable second restraint part, which can be brought into contact with the second pawl in order to restrain the second pawl against the prestressing of the pawl prestressing element, such that the second pawl does not engage in the second ratchet wheel, with the second restraint part being designed such that the contact between the second restraint part and the second pawl is released when the second movement state occurs, so that the second pawl can engage in the second ratchet wheel.

21. The control unit as claimed in claim 8, with the activation mechanism having a first bolt with a first bolt prestressing element, with the first bolt being moveable to an inactive position and to an active position, and being designed in order to restrain any movement of the first pawl in the direction of the first ratchet wheel when it is in the inactive position, and in order to allow movement of the first pawl in the direction of the first ratchet wheel when it is in the active position, and with the first bolt prestressing element prestressing the first bolt towards the inactive position.

22. The control unit as claimed in claim 21, with the first bolt having a driver which is arranged such that a spindle nut can move the first bolt, against the prestressing of the first bolt prestressing element, to the active position by interaction with the driver, when the spindle nut is in a first switching state.

23. The control unit as claimed in claim 21, with the second bolt having a driver which is arranged such that a spindle nut can move the second bolt, against the prestressing of the second bolt prestressing element, to the active position by interaction with the driver, when the spindle nut is in the second switching state.

24. The control unit as claimed in claim 21, with the first bolt and the second bolt being arranged parallel to one another, and being prestressed in opposite directions.

25. The control unit as claimed in claim 24, with the activation mechanism comprising a first bolt pusher, for pushing the first bolt against the prestressing as a function of the rotation angle of a setting shaft, which is rotatable about a setting axis, with a first and a second rotation angle of the setting shaft about the setting axis respectively defining a first and a second setting state.

26. The control unit as claimed in claim 25, with the first bolt pusher having an end surface which is rotatable together with the setting shaft and is arranged at an inclined angle with respect to the setting axis, such that the end surface moves the first bolt to the active position, against the prestressing of a first bolt prestressing element, when the first setting state occurs.

27. The control unit as claimed in claim 24, with the activation mechanism comprising a second bolt pusher, for pushing the second bolt against the prestressing as a function of the rotation angle of a setting shaft, which is rotatable about a setting axis, with a first and a second rotation angle of the setting shaft about the setting axis respectively defining a first and a second setting state.

28. The control unit as claimed in claim 27, with the second bolt pusher having an end surface which is rotatable with the setting shaft and is arranged at an inclined angle with respect to the setting axis, such that the end surface moves the second bolt to the active position, against the prestressing of a second bolt prestressing element, when the second setting state occurs.

29. The control unit as claimed in claim 8, with the activation mechanism having a second bolt with a second bolt prestressing element, with the second bolt being moveable to an inactive position and to an active position, and being designed in order to restrain any movement of the second pawl in the direction of the second ratchet wheel when it is in the inactive position, and in order to allow movement of the second pawl in the direction of the second ratchet wheel when it is in the active position, and with the second bolt prestressing element prestressing the second bolt towards the inactive position.

30. The control unit as claimed in claim 1, having a locking system for locking an access for an electrical switching device, comprising a setting shaft, which is rotatable about a setting axis, for setting a plurality of setting states by selection of the rotation angle of the setting shaft, with the plurality of setting states comprising a first setting state and a second setting state; and a locking disk which is rotatable together with the setting shaft, with at least one of the plurality of setting states being a locked setting state, and with at least one of the plurality of setting states being an unlocked setting state, and with the locking disk locking the access to the operating system when a locked setting state occurs, and releasing the access to the operating system when an unlocked setting state occurs.

31. A locking system for locking an access for an electrical switching device, comprising a setting shaft, which is rotatable about a setting axis, for setting a plurality of setting states by selection of the rotation angle of the setting shaft, with the plurality of setting states comprising a first setting state and a second setting state; and a locking disk which is rotatable together with the setting shaft, the locking disk having a cutout for releasing an access to an operating system, with at least one of the plurality of setting states being a locked setting state, and with at least one of the plurality of setting states being an unlocked setting state, and with the locking disk locking the access to the operating system when the locked setting state occurs by rotating the cutout to block an opening which allows access to the electrical switching device, and in order to release the access to the operating system when an unlocked setting state occurs by rotating the cutout to be aligned with the opening which allows access to the electrical switching device.

32. The locking system as claimed in claim 31, with a plurality of setting states being lock-secured setting states in each case being lock-secured by means of a lock, which can be locked and opened by a key and which blocks rotation of the setting shaft when the lock-secured state occurs and the lock is locked.

33. The locking system as claimed in claim 32, with the locking disk having a blocking section, and with the at least one lock being designed in order to engage in the blocking section and thus to prevent rotation of the locking disk, when the lock is locked, and in order to release an engagement in the blocking section, and thus to allow rotation of the locking disk, when the lock is open.

34. The locking system as claimed in claim 31, with the setting shaft having a cam which is arranged in order to operate a switch when the setting shaft assumes a defined setting state.

35. The locking system as claimed in claim 31, with the plurality of setting states comprising a locked setting state for automatic operation of a moveable contact, an unlocked setting state for manual operation of the moveable contact, and two locked setting states for respectively blocking the moveable contact with the switching device being in an open or closed switching state.

* * * * *